US005457665A

United States Patent [19]

Reid

[11] Patent Number: 5,457,665

[45] Date of Patent: Oct. 10, 1995

[54] ELAPSED TIME INDICATOR

[75] Inventor: Henry C. Reid, Safety Harbor, Fla.

[73] Assignee: Innova Pure Water Inc., Clearwater, Fla.

[21] Appl. No.: 208,388

[22] Filed: Mar. 10, 1994

[51] Int. Cl.[6] ..... G04F 1/08

[52] U.S. Cl. ..... 368/93; 368/95

[58] Field of Search ..... 368/10, 89–95, 368/327

[56] References Cited

U.S. PATENT DOCUMENTS

| | | | |
|---|---|---|---|
| 3,025,665 | 3/1962 | Dock et al. | 368/94 |
| 3,465,516 | 9/1969 | Von Meter | 368/95 |
| 3,553,959 | 1/1971 | Young et al. . | |
| 3,774,407 | 11/1973 | Bright . | |
| 3,938,315 | 2/1976 | Von Klemenczkt | 368/94 |
| 4,054,026 | 10/1977 | Goodrich | 368/93 |
| 4,090,356 | 5/1978 | Arnold . | |
| 4,228,649 | 10/1980 | Weiss . | |
| 4,419,016 | 12/1983 | Zoltan | 368/10 |
| 4,998,228 | 3/1991 | Eger et al. . | |

*Primary Examiner*—Vit W. Miska
*Attorney, Agent, or Firm*—Nixon & Vanderhye

[57] ABSTRACT

An elapsed time indicator can easily indicate time periods of over a month, and is extremely versatile, for example being utilizable in a cap of a water bottle. The indicator includes a substantially transparent and substantially straight tube having first and second ends, an interior and an exterior, with a viscous liquid substantially filling the interior of the tube. A visible indicator, such as a polypropylene spherical bead, a magnetite/wax bead, or a fluid immiscible in the viscous liquid, is immersed in the viscous liquid and dimensioned and positioned with respect to the tube so that it can travel from the first to the second end in a known predetermined period of time when the tube is generally vertical. The time it takes for travel may be precisely calculated. The indicator may be held in a stationary position at one end of the tube, e.g. by clamping a flexible tube end, or using a magnet, prior to initial use. A scale may indicate the relative position of the indicator, and more than one indicator in the same tube, or different in-line and adjacent tubes with different indicators, can be provided.

24 Claims, 3 Drawing Sheets

FIG. 1
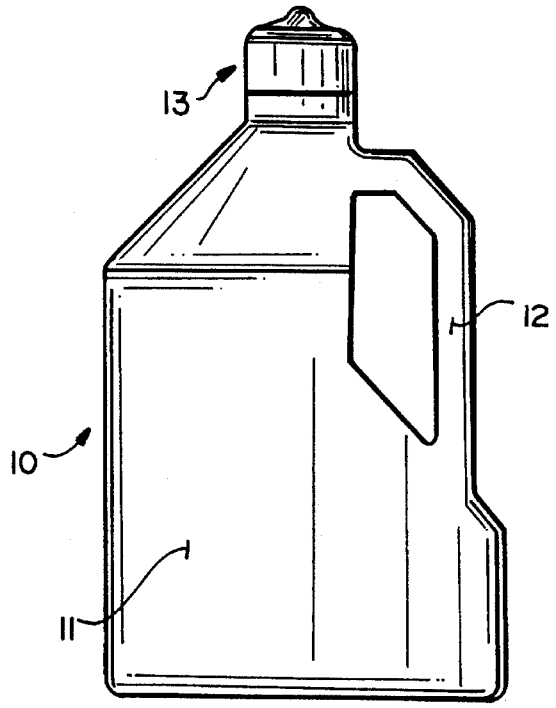
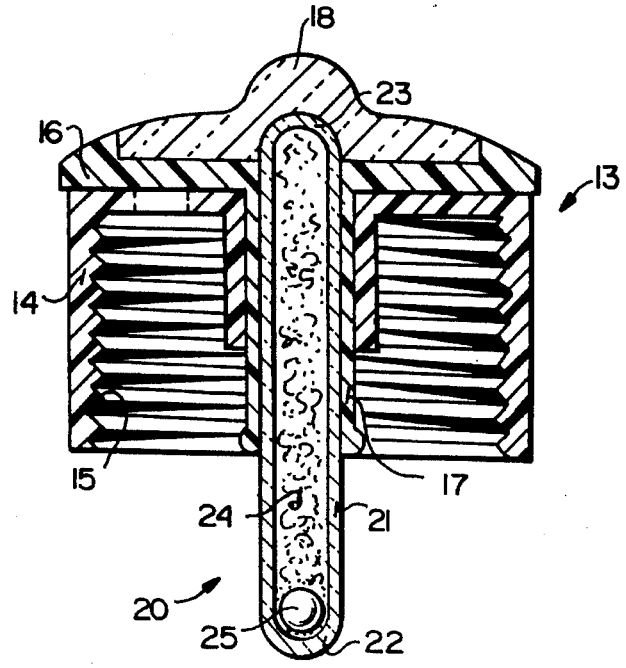
FIG. 2

ELAPSED TIME INDICATOR

BACKGROUND AND SUMMARY OF THE INVENTION

Elapsed time indicators, such as hourglasses, have been known since ancient times. More modern elapsed time indicators have extremely diverse and varied constructions. For example electronic timers can be utilized, manual indicators can be advanced by a user, a soluble glass disk can dissolve in water, or brush bristles can irreversibly change color. However the majority of such prior art elapsed time indicators have several significant disadvantages or limitations associated therewith. For example some of them, such as hourglasses, are limited to relatively short periods of time, others, such as electronic timers, are complex and relatively expensive, others, such as those which irreversibly change color, cannot be effectively reused, while still others are not suitable for use in association with products that will be ingested by humans.

According to the present invention an elapsed time indicator, and various specific embodiments for use thereof, is provided which is inexpensive, essentially infinitely reusable, can be used to determine a wide variety of different time periods (including time periods of more than a month), may be used in contact with human ingestible materials, yet still is accurate. Particularly desirable applications of the elapsed time indicator are to time the usage of water treatment filters, and to time the storage period for perishable foods, however the variety of uses of the elapsed time indicator according to the present invention is virtually infinite.

According to one aspect of the present invention an elapsed time indicator is provided comprising the following elements: A substantially transparent and substantially straight tube having first and second ends, an interior, and an exterior. A viscous liquid substantially filling the interior of the tube. A visible indicator immersed in the viscous liquid and dimensioned and positioned with respect to the tube so that the visible indicator can travel from the first end to the second end through the viscous liquid and vice versa. And, the liquid and the visible indicator being selected so that there is a known predetermined time period for the visible indicator to travel through the liquid between the first and second ends when the tube has a particular orientation with respect to the vertical.

Preferably the visible indicator is substantially spherical, and the interior diameter of the tube is about twice the diameter of the visible indicator. In this case, the predetermined time period can be precisely (for all practical purposes) calculated. The predetermined time period is determined by L/S where L is the distance between the first and second ends of the tube location of the visible indicator in cm, and $S^{=}(2/9)R^2 A\Delta D/V$, where S=the speed of the spherical visible indicator in cm/s, R=the radius of the spherical visible indicator in cm, $\Delta D$=the density difference between the spherical visible indicator and the fluid in gm./cm$^3$, A=the acceleration of gravity (981 cm./s$^{-2}$), and V=the absolute viscosity of the fluid in gm./cm second.

The time indicator can include means for releasably holding the visible indicator in a stationary position at one of the ends thereof until activated. For example the tube may be of a flexible plastic material, at least adjacent the first end thereof, and the releasable holding means may comprise a clamp for deforming the tube to clamp the visible indicator to the tube until the clamp is released. Alternatively the visible indicator can be of magnetic material (e.g. of magnetic ferris hydroxide—magnetite—in wax), and the releasable holding means may comprise a magnet.

The viscous liquid (the term "liquid" being used very generically to include gels or other semi-solids, or semi-liquids) can be of a wide variety of materials, and preferably is a material that is not toxic to humans. For example one material that can be utilized is polydimethylsiloxane, such as available from General Electric by the trade name "Viscasil". Such a liquid typically has a kinematic viscosity of about 100,000 centistokes, but the viscosity of the liquid utilized according to the invention can vary widely depending upon the time period desired to measure from about 1,000 centistokes to well over 100,000 centistokes. The viscous liquid also must be compatible with the material of the tube, which may be glass, acrylic, or a flexible tubing material such as plastic tubing sold under the trademark "Tygon" by Norton Company of Worcester, Mass.

The visible indicator may take a wide variety of forms and constructions. Most commonly it would comprise a sphere of non-toxic solid material, such as high density polypropylene, or wax. If a magnetic indicator is desired a blend of magnetite in wax can be provided. However the visible indicator need not be a solid at all but can be a fluid immiscible in the viscous liquid. For example annato oil, or dyed water are both immiscible in silicone oil and form round beads. However when using fluid visible indicators it may be necessary to treat the interior of the tube so that the indicating fluid does not wet the inside of the tube and stick to it when the end of travel position is reached. The visible indicator can be of any color, which preferably clearly contrasts with the color of the viscous liquid, for example black, red, high visibility orange, white, etc.

It is also possible to utilize more than one visible indicator within a tube, or to provide a plurality of tubes in line or adjacent each other so that a differential and speed of movement of the indicators can be provided. Also there is no necessity that either the tube or the indicator have a circular cross-section, but rather they may be distinctly non-circular, such as polygonal in cross-section in the case of the tube, and polygonal, cross-shaped, or the like, in the case of the visible indicators.

Typically the tube is mounted during use so that it is generally vertical (precisely vertical, or at some angle to the vertical that is known, but not horizontal). The mounting means can mount the tube so that it can be inverted so that either end may be disposed vertically above the other, or so that it can be readily removed from the mount and inverted and then replaced in the mount.

The visible indicator and viscous liquid can be selected (by changing the materials, shapes, and a wide variety of other variables) so that almost any desired passage of time can be indicated. The indicators according to the invention are perhaps most useful, however, when the indicate the passage of about one day or more for travel of the visible indicator from the first end of the tube to the second end, or vice versa, if the indicator is maintained at generally ambient temperatures (e.g. about 5°–30° C.). For some uses, such as for water filters, the passage of at least about 30 days (e.g. about 30–60 days) is a most desirable indicator time, while for a product shelf life the time period may be even greater than 60 days. The tube may also be mounted adjacent a scale or another graduated indicator so that the position of the visible indicator with respect to the tube can be easily discerned.

The indicator according to the invention is particularly desirable for use in or on a water bottle having a filter, which filter should be replaced or regenerated after the passage of the predetermined period of time. For example the elapsed time indicator according to the invention may be built directly in a tubular cap for the water bottle.

According to another aspect of the present invention a cap for a water bottle is provided comprising: A tubular cap body having interior and exterior side surfaces, and a top surface. Surface manifestations provided on the interior or exterior side surfaces for holding the cap body onto a bottle neck. The cap top surface including a transparent portion. An elapsed time indicator. And, means for mounting the elapsed time indicator radially interiorly of the cap body side surfaces so that the indicator is visible through the transparent portion of the cap body top surface.

The elapsed time indicator utilized in the cap as described above may comprise: A substantially transparent tube having first and second ends, and an interior; a viscous liquid substantially filling the interior of the tube; a visible indicator immersed in the viscous liquid; and the liquid and indicator being selected so that it takes the passage of at least about 30 days at a temperature range of about 5°–30° C. for the indicator to move from one end of the tube to the other; and wherein the means for mounting the elapsed time indicator mounts the tube so that one of the ends thereof is adjacent to and visible through the cap transparent portion, and so that the tube is generally vertical when the cap top surface is generally horizontal. The mounting means preferably firmly but releasably holds the tube in place, so that the tube may be removed from the cap and inverted and then replaced. Of course the tube, viscous liquid, and visible indicator are all made of materials non-toxic to humans in this embodiment.

It is the primary object of the present invention to provide an inexpensive, reusable (not requiring use or intervention except to view, and at the end of the elapsed time invert), and accurate elapsed time indicator, and structures for utilization thereof. This and other objects of the invention will become clear from an inspection of the derailed description of the invention, and from the appended claims.

BRIEF DESCRIPTION OF THE DRAWINGS

FIG. 1 is a side view of an exemplary water bottle utilizing a cap-mounted elapsed time indicator according to the present invention:

FIG. 2 is a detail side cross-sectional view of the cap and indicator of the bottle of FIG. 1;

DETAILED DESCRIPTION OF THE DRAWINGS

Figure 3:
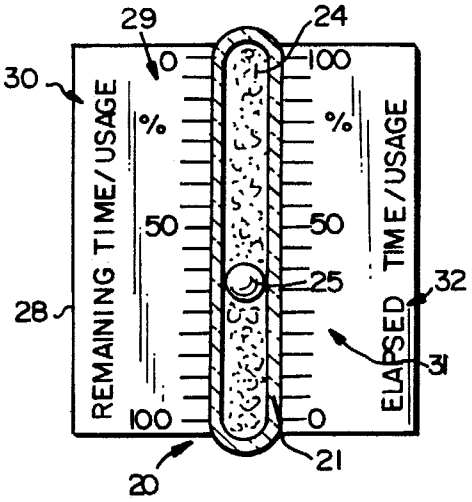
FIG. 3 is a side view of the indicator per se of FIG. 2 shown mounted in association with a scale.

FIG. 1 illustrates an exemplary water bottle with indicator 10 according to the present invention, the bottle having a body 11 and having filter media disposed within the bottle in any conventional manner, and having a handle 12 to allow tilting of the bottle to pour the liquid. A cap 13 is provided at the top of the bottle body 11, typically screwed on or otherwise in engagement with the neck of the bottle 11.

The exemplary cap 13, with indicator, according to the present invention is seen most clearly in FIG. 2. The cap 13 includes a tubular cap body 14 having interior and exterior side surfaces, with surface manifestations—such as the screw threads 15 illustrated on the interior side surfaces in FIG. 2—on one or both of the interior and exterior side surfaces for holding the cap body 14 on the neck of a bottle. The cap body 14 also has a top surface 16, and the mounting flange 17 typically extends down from the top surface 16. The cap top surface 16 also preferably comprises a transparent portion 18, shown in FIG. 2 in the form of a transparent cap lens. An elapsed time indicator 20 is mounted in the cap 13, such as by being mounted in the tubular mounting structure 17 which provides a friction fit which positively holds the elapsed time indicator 20 in place during normal usage, but allows it to be removed and inverted.

The preferred elapsed time indicator 20 according to the present invention comprises a substantially transparent and substantially straight tube 21 having first and second sealed, integral ends 22, 23, and an interior and exterior. In FIG. 2 the tube 21 is shown with a circular cross-section, but other cross-sections may be provided. The term "substantially transparent" in describing the tube means that there will be a portion of the tube that is transparent so that a visible indicator therein may be viewed. Typically this is most easily and inexpensively and functionally accomplished by making the entire tube 21 of the same transparent material (such as glass, acrylic, or different types of plastics that are either rigid or flexible), and of course is of a non-toxic material since it is likely to come into contact with the water in the bottle 11. However under some circumstances only part of the tube 21 (e.g. one or both ends 22, 23) need be transparent or translucent.

Substantially filling the interior of the tube 21 is a viscous liquid 24. The liquid may be silicone oil (polydimethylsiloxane), such as that available from General Electric under the trade name "Viscasil", and having a kinematic viscosity at ambient temperature of about 100,000 centistokes. Typical viscosity ranges for the viscous fluid 24 are from about 1,000 centistokes to more than 100,000 centistokes, of course depending upon the predetermined time period desired, and other factors. The relatively small amount of silicone oil 24 in the tube 21 will not be toxic to humans, and is readily visible, if the tube 21 should break for some reason. The liquid 24 may be of any desired color and preferably is transparent or translucent (so that a visible indicator therein may be readily seen).

The elapsed time indicator 20 also comprises a visible indicator 25 immersed in the viscous liquid 24 and dimensioned and positioned with respect to the tube 21 so that it can travel from the first end 22 to the second end 23 through the viscous liquid, and vice versa. For ease of construction and for ease of calculation of the time period of travel, the visible indicator 25—as illustrated in FIG. 2—preferably is circular in cross-section, and most preferably is substantially spherical. It can be made of a wide variety of materials which have a density different compared to the viscous liquid 24. For example several materials that may be utilized with silicone oil as the viscous fluid 24 of which the visible indicator 25 may be constructed include high density polypropylene (of white, red, high visible orange, or almost any color), or wax. The density of the visible indicator 25 may be greater or less than the density of liquid 24.

The density of the liquid 24 and the indicator 25 are selected—as are their cross-sectional configurations, shapes, size, viscosity of the liquid, the angle of the tube with respect to the vertical, etc.—so that there is a known predetermined period of time for the visible indicator 25 to traverse the length of the tube 21. For example if the liquid 24 is silicone oil with a kinematic viscosity of about 100,000 centipoise, and the visible indicator 25 is a white high density polypropylene bead, and if the tube 21 is acrylic with an inside diameter about twice as great as the diameter of the bead 25, at room temperature the bead 25 would rise about 0.036 inches per day, or about 1.1 inches per month. Thus if the effective life of the filtration media associated with the device 10 were a month, the tube 21 need only be 1.1 inches long from the end of travel position of the bead 25 and the ends 22, 23. After the passage of a month, which is clearly seen by viewing the indicator 20 through the transparent cap portion 18, the user can remove the tube 21 from the mount 17 after the filtration media has been replaced, invert it, and reinsert it so that the end 23 is then at the bottom, and the bead 25 (of less density than the fluid 24) will then start to slowly rise again.

A formula can be applied to calculate the predetermined time period. The following assumptions and calculation are applicable: This system has a very low Reynolds number which means that inertial forces can be neglected, flow is laminar, and the bead (visible indicator 25) does not leave a wake. Under these conditions the force on a sphere moving through a fluid is:

ti $F=6\pi VSR$

Where:

F=drag force acting on the sphere

V=viscosity of the fluid

S=speed of the sphere

R=radius of the sphere $\pi$=3.1415 . . .

Since the sphere moves upward with a constant velocity the drag force must be balanced by a buoyant force whose magnitude will be the acceleration of gravity (A) multiplied by the density difference between the sphere and the fluid ($\Delta D$) multiplied by the volume of the sphere ($4/3\pi R^3$). If the density of the sphere is greater than the density of the fluid the motion will be downward; if the density of the fluid is greater the motion will be upward.

These equations can be rearranged as follows:

$$S=F/(6\pi V R)$$

$$F=A\ \Delta D\ (4/3\pi R^3)$$

$$S=A\ \Delta D\ (4/3\pi R^3)/(6\pi V R)$$

yielding the speed equation:

$$S=(2/9)\ A\ \Delta D\ R^2/V;$$

or yielding the time equation $$T=L/S$$

Where:

S=speed of the sphere

A=acceleration of gravity $\Delta D$=density difference between sphere and fluid R=radius of sphere V=viscosity of the fluid L=the distance between the end positions of the sphere in the tube T=the "predetermined time"

| Name | Variable | Units |
|---|---|---|
| S | speed of bead | centimeters/second |
| A | acceleration of gravity | 981 centimeters/ second$^2$ |
| $\Delta D$ | density difference between bead and fluid | grams/centimeter$^3$ |
| R | radius of bead | centimeters |
| V | viscosity of fluid | grams/centimeter second |
| L | distance | centimeters |
| T | time | seconds |

The viscosity is absolute viscosity as distinguished from kinematic viscosity (which is absolute viscosity divided by density).

This formula describes a bead 25 floating or sinking in a tube 21 at least larger than twice the diameter of the bead. If the inside of the tube is smaller the speed of the bead will be reduced because of the constriction of the fluid flowing around the bead.

Speed varies linearly with density difference, speed varies inversely with viscosity, and speed varies as the square of radius. If nonspherical beads are used an experimentally determined shape constant should be substituted for (2/9) in the above equation and the value of R should be some dimension of the bead.

FIG. 3 illustrates the same indicator 20 as illustrated in FIG. 2, but only with a different mounting mechanism that is not tied in with the bottle, although it could be. For example the indicator 20 as illustrated in FIG. 3 could be attached by repositional adhesive, a clamp, magnet, or in another way, to the exterior of the bottle 11 or other conveniently visible location.

The indicator 20 in FIG. 3 is mounted by a mounting plate 28 which has position indicating indicia thereon, such as the numerical indicia 29, 31 and the verbiage 30, 32. This allows one to see how much time is remaining and how much time has elapsed since the visible indicator 25 was at the first (bottom) end 22 of the tube 21. Of course other position indicating means may be utilized besides that illustrated in FIG. 3, the scale and particular indicia therein being only exemplary.

Figure 6:
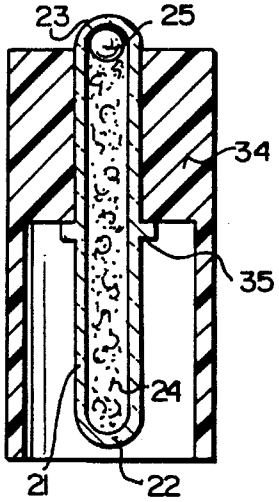
FIGS. 4 through 6 are side cross-sectional views of the indicator of FIGS. 2 and 3 mounted by a mounting mechanism and showing the end of travel in intermediate positions thereof.
Figure 5:
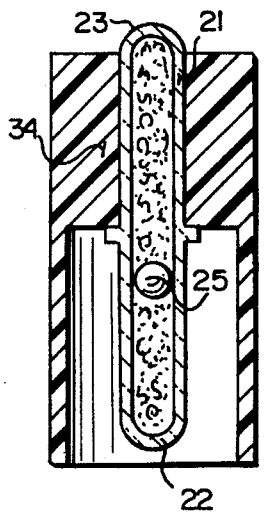
Figure 4:
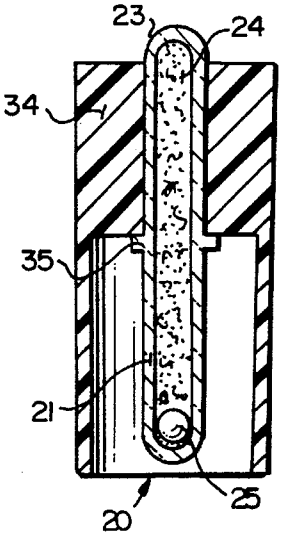

FIG. 4 shows the elapsed time indicator 20 of FIGS. 2 and 3 with a different mounting means 34, in this case a body of plastic. The optional positioning rib 35 may be provided on the robe 21 for properly positioning it in the housing 34, and the housing 34 may be of opaque material, such as an opaque plastic, so that the bead 25 is visible only when it passes the top surface of the housing 34, at the second end 23 thereof. FIG. 4 shows the position of the bead 25 when the time period begins, FIG. 5 shows the position after it has partially lapsed, while FIG. 6 shows it in the completely elapsed position.

Figure 7:
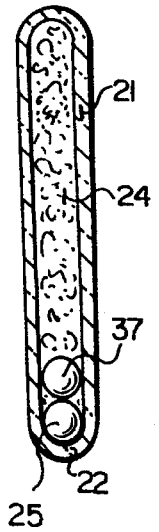
FIG. 7 is a side view of another embodiment of elapsed time indicator according to the invention.

FIG. 7 illustrates an embodiment in which two different beads with different rise rates are shown in the same tube 21. For example the bead 37 is less dense (and perhaps of different shape) than the bead 25, and therefore will rise more quickly away from the end 22 of the tube 21. For example the bead 25 may be high density polypropylene while the bead 37 is wax. This may be used, for example, where two different time intervals need to be displayed. Fruits and vegetables, for example, may require a certain period of time to ripen and spoil after a longer period of time has passed. For such applications the timer with two indicating beads 25, 37 moving at different rates is ideal. Thus after one indicating bead 37 has reached the end of the tube 21 providing its intended signal, the second indicating bead 25 is at a location which shows the user the elapsed time since the first indicating bead 37 timed out. When the second indicating bead 25 reaches its final position it shows that the longer period of time has elapsed. The first indicating bead 37 might show when fruit has ripened (e.g. 10 days) and the second indicating bead 25 might show when fruit has spoiled (e.g. another 10 days).

Figure 8:
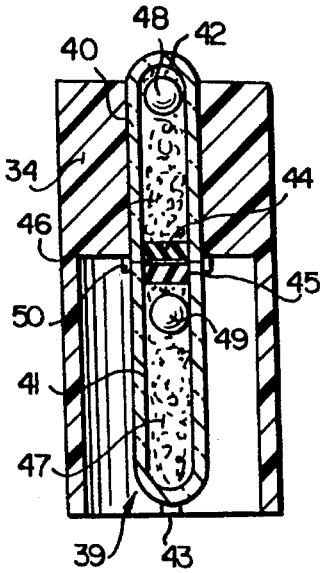
FIG. 8 is a view like that of FIG. 6 only showing a variation of the elapsed time indicator.

FIG. 8 indicates another modification of elapsed time indicator according to the invention, in this case the indicator in general being illustrated by reference numeral 39, and being shown in a housing 34 like that of FIGS. 4 through 6. In this case the two tubes 40 and 41, having ends 42 and 43, are separated by the seals (e.g. rubber or other resilient material) 44, 45. The tubes 40 and 41 may be connected together by the optional positioning and holding rib 50. Separate viscous fluids 46, 47 are defined in the compartments on opposite sides of the seals 44, 45, with different visible indicators 48, 49 therein.

Figure 9:
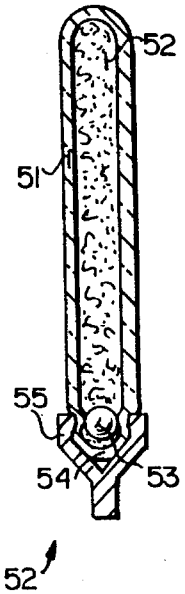
FIG. 9 is a view like that of FIG. 7 only showing a modified form of the elapsed time indicator.

FIG. 9 illustrates a elapsed timed 51 according to the present invention which has means for releasably holding the visible indicator 53 in the fluid 52 in a stationary position at one end (the end 54) of the indicator 51. The releasable holding means comprises a removable clamp 55 which squeezes the tube 56, which is made of flexible material, such as a flexible transparent plastic sold under the trademark "Tygon" sold by Norton Company of Worcester, Mass. For simplicity it is preferred that the entire tube 56 be flexible, although it is only necessary to provide flexibility at the end 54 thereof. Once the clamp 55 is removed, then the visible indicator 53 may start "timing", by moving toward the opposite end of the tube 56. By utilizing the mechanism 55 with the flexible tube 56 it is possible to deliver the elapsed time indicator already at a "start" position.

Figure 10:
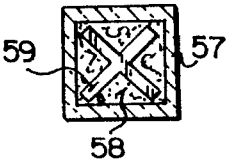
FIG. 10 is a horizontal cross-sectional view of another modification of indicator according to the invention.

FIG. 10 schematically illustrates that neither the tube nor the visible indicator of the time elapse indicator according to the present invention need be circular in cross-section. Distinctly non-circular cross-sectional configurations are also possible. For example in FIG. 10 the tube 57 is shown with a polygon cross-section (in this case a square), with the viscous fluid 58 surrounding the visible indicator 59, which also is distinctly noncircular in configuration (in this case in the shape of an "X" or cross).

Figure 11:
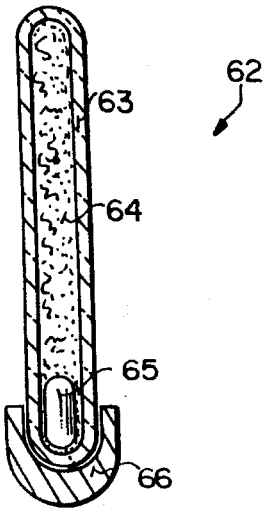
FIG. 11 is a side cross-sectional view of yet another modification of indicator according to the invention.

FIG. 11 shows another modification of a elapse time indicator 62 according to the present invention which has another type of means for releasably holding the visible indicator in a stationary position at one end of the tube 63, as an alternative to the configuration of FIG. 9. In this particular case the visible indicator 65 which is in the viscous fluid 64 is of a magnetic material, such as a black magnetic indicator 65 having a generally cylindrical or "capsule" shape, and made of magnetite and wax. A permanent magnet 66 surrounds the tube 63 at the end 67 thereof, holding the magnetic visible indicator 65 in place. The magnet 66 may be connected to the tube 63 by a releasable adhesive, tape, or using a wide variety of other techniques. In the FIG. 11 embodiment the tube 63 may be rigid, rather than requiring a flexible portion as in the FIG. 9 embodiment.

While FIGS. 9 and 11 show two exemplary embodiments of the releasable holding means, it is to be understood that any mechanism for performing the releasable holding function may be utilized whether exterior or interior of the tube; for example by subjecting the tube to an unusual environmental condition such as heat or vibration, the visible indicator can be dislodged from its initial position, or a wide variety of other mechanical devices may be utilized.

An exemplary use of the elapsed time indicator 20 will now be described specifically with respect to FIGS. 1 and 2, this use being merely exemplary.

With the bead 25 in the position illustrated in FIG. 2 (at the end 22 of the tube 21), and with a new filtration media in the bottle 11, the user screws the cap 13 on the neck of the bottle 11. The bottle 11 is typically filled with water, and occasionally refilled, filtration occurring either while the water is in the bottle 11 or as the bottle is filled, as is known and conventional per se. While when the bottle 11 is being refilled the cap 13 is typically laid on its side, a short duration disturbance of the cap 13 from its normally vertical position (with the end 22 essentially directly vertically below the end 23) does not have a significant affect on the time lapse that will be indicated by the indicator 20. Normally the bottle 11 will be maintained (whether in a refrigerator or in the ambient atmosphere) in the position illustrated in FIG. 1 with the cap 13 at the top thereof.

After passage of the expected life of the filtration media, e.g. 30 days, the bead 25 has travelled up through the viscous fluid 24 to the end 23 of the tube 21. At the end 23 it is readily visible through the transparent cap lens 18 of the cap 13, and the user then knows that it is time to replace the filtration media. Once the filtration media has been replaced, the tube 21 is merely withdrawn from the mount 17, inverted, and replaced this time with the end 23 at the bottom (where the bead 25 is at that point). This may be practiced indefinitely.

It will thus be seen that according to the present invention a simple, inexpensive, essentially infinitely reusable, safe, and accurate elapsed time indicator—as well as various mechanisms for specifically utilizing it—has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An elapsed time indicator comprising:

a substantially transparent and substantially straight tube having first and second ends, an interior, and an exterior;

a viscous liquid substantially filling the interior of said tube;

a first visible indicator immersed in said viscous liquid and dimensioned and positioned with respect to said tube so that said first visible indicator can travel from said first end to said second end through said viscous liquid and vice versa;

said liquid and said first visible indicator being selected so that there is a known predetermined time period for said first visible indicator to travel through said liquid between said first and second ends when said tube has a particular orientation with respect to the vertical; and a second visible indicator disposed in said tube, said second visible indicator always positioned closer to said second end of said tube than said first visible indicator.

2. An elapsed time indicator as recited in claim 1 wherein said first visible indicator is substantially spherical and wherein the interior diameter of said tube is at least twice the diameter of said first visible indicator, and wherein said predetermined time period is equal to L/S where L is the distance between said first and second ends of said tube location of the first visible indicator in cm, and $S=(2/9)R^2 A\Delta D/V$, where S=the speed of the spherical visible indicator in cm/s, R=the radius of the spherical first visible indicator in cm, ΔD=the density difference between said spherical visible indicator and said fluid in gm./cm$^3$, A=the acceleration of gravity (981 cm./s$^2$), and V=the absolute viscosity of said fluid in gm./cm second.

3. An elapsed time indicator as recited in claim 1 further comprising means for releasably holding said first visible indicator in a stationary position at one of said first and second ends.

4. An elapsed time indicator as recited in claim 3 wherein said first visible indicator is of magnetic material, and wherein said means for releasably holding said first visible indicator comprises a magnet.

5. An elapsed time indicator as recited in claim 1 wherein said first visible indicator is distinctly non-circular in cross-section.

6. An elapsed time indicator as recited in claim 1 further comprising position indicating means mounted to said tube for indicating the position of said first visible indicator between said first and second ends of said tube.

7. An elapsed time indicator as recited in claim 1 further comprising mounting means for mounting said tube so that it is vertically oriented and can be inverted so that either said first or said second end may be disposed vertically above the other.

8. An elapsed time indicator as recited in claim 1 wherein said first visible indicator and said viscous liquid are selected so that said elapsed time indicator indicates the passage of about one day or more when said first visible indicator passes from said first end to said second end, or vice-versa, if maintained at a temperature between about 5°–30°.

9. An elapsed time indicator as recited in claim 1 wherein said first visible indicator and said viscous liquid are selected so that said elapsed time indicator indicates the passage of about 30–60 days when said first visible indicator passes from said first end to said second end, or vice-versa, if maintained at a temperature between about 5°–30° C.

10. An elapsed time indicator as recited in claim 1 wherein said time indicator is mounted in or on a water bottle having a filter associated therewith, which filter should be replaced or regenerated after the passage of said predetermined period of time.

11. An elapsed time indicator as recited in claim 10 wherein said visible indicator has a density less than the density of said viscous liquid; wherein said water bottle has a neck, and a cap with surface manifestations for connecting the cap to the neck of said water bottle, said cap having a transparent top surface; and wherein said tube is mounted in said cap so that said second end of said tube is visible through said cap transparent top surface and said second end of said tube is above said first end when said bottle is in an upright position with said cap at the top of said neck.

12. An elapsed time indicator as recited in claim 1 wherein said viscous liquid comprises polydimethylsiloxane, said visible indicator comprises high density polypropylene, magnetite, dyed water, annato oil, or wax, and said tube is made of glass, acrylic, or flexible plastic.

13. A cap for a bottle comprising:

a tubular cap body having interior and exterior side surfaces, and a top surface;

surface manifestations provided on said interior or exterior side surfaces for holding said cap body onto a bottle neck;

said cap top surface including a transparent portion;

an elapsed time indicator; and means for mounting said elapsed time indicator radially interiorly of said cap body side surfaces so that said indicator is visible through said transparent portion of said cap body top surface; and said elapsed time indicator comprising: a substantially transparent tube having first and second ends, and an interior; a viscous liquid substantially filling the interior of said tube; a visible indicator immersed in said viscous liquid; and said liquid and indicator being selected so that it takes the passage of at least about 30 days at a temperature range of about 5–30 degrees C. for said indicator to move from one end of said tube to the other; and wherein said means for mounting said elapsed time indicator mounts said tube so that one of said ends thereof is adjacent to and visible through said cap transparent portion, and so that said tube is generally vertical when said cap top surface is generally horizontal.

14. A cap as recited in claim 13 wherein said tube, viscous liquid, and visible indicator are all made of materials non-toxic to humans.

15. A cap as recited in claim 13 wherein the mounting means firmly but releasably holds said tube in place so that said tube may be removed and inverted, and then replaced.

16. An elapsed time indicator comprising:

a substantially transparent and substantially straight tube having first and second ends, an interior, and an exterior;

a viscous liquid substantially filling the interior of said tube;

a visible indicator immersed in said viscous liquid and dimensioned and positioned with respect to said tube so that said visible indicator can travel from said first end to said second end through said viscous liquid and vice versa;

said liquid and said visible indicator being selected so that there is a known predetermined time period for said visible indicator to travel through said liquid between said first and second ends when said tube has a particular orientation with respect to the vertical;

means for releasably holding said visible indicator in a stationary position at one of said first and second ends; and wherein said tube is flexible at least adjacent said first end thereof, and wherein said means for releasably holding said visible indicator in a stationary position comprises a clamp for deforming said tube adjacent said first end thereof to clamp said visible indicator to said tube thereat.

17. A time indicator as recited in claim 16 wherein said time indicator is mounted in or on a water bottle having a filter associated therewith, which filter should be replaced or regenerated after the passage of said predetermined period of time.

18. An elapsed time indicator as recited in claim 17 wherein said visible indicator has a density less than the density of said viscous liquid; wherein said water bottle has a neck, and a cap with surface manifestations for connecting the cap to the neck of said water bottle, said cap having a transparent top surface; and wherein said tube is mounted in said cap so that said second end of said tube is visible through said cap transparent top surface and said second end of said tube is above said first end when said bottle is in an upright position with said cap at the top of said neck.

19. A time indicator as recited in claim 16 wherein said visible indicator is substantially spherical and wherein the interior diameter of said tube is at least twice the diameter of said visible indicator, and wherein said predetermined time period is equal to L/S where L is the distance between said first and second ends of said tube location of the visible indicator in cm, and $S^{=}(2/9)R^2 A\Delta D/V$, where S=the speed of the spherical visible indicator in cm/s, R=the radius of the spherical visible indicator in cm, ΔD=the density difference between said spherical visible indicator and said fluid in gm./cm$^3$, A=the acceleration of gravity (981 cm./s$^2$), and V=the absolute viscosity of said fluid in gm./cm second.

20. A time indicator as recited in claim 16 wherein said visible indicator and said viscous liquid are selected so that said elapsed time indicator indicates the passage of about one day or more when said visible indicator passes from said first end to said second end, or vice-versa, if maintained at a temperature between about 5°–30°.

21. An elapsed time indicator mounted in or on a water bottle having a filter associated therewith, which filter should be replaced or regenerated after the passage of said predetermined period of time, and comprising:

a substantially transparent and substantially straight tube having first and second ends, an interior, and an exterior;

a viscous liquid substantially filling the interior of said tube;

a visible indicator immersed in said viscous liquid and dimensioned and positioned with respect to said tube so that said visible indicator can travel from said first end to said second end through said viscous liquid and vice versa;

said liquid and said visible indicator being selected so that there is a known predetermined time period for said visible indicator to travel through said liquid between said first and second ends when said tube has a particular orientation with respect to the vertical;

wherein said visible indicator has a density less than the density of said viscous liquid;

wherein said water bottle has a neck, and a cap with surface manifestations for connecting the cap to the neck of said water bottle, said cap having a transparent top surface; and wherein said tube is mounted in said cap so that said second end of said tube is visible through said cap transparent top surface and said second end of said tube is above said first end when said bottle is in an upright position with said cap at the top of said neck.

22. A time indicator as recited in claim 21 wherein said visible indicator is substantially spherical and wherein the interior diameter of said tube is at least twice the diameter of said visible indicator, and wherein said predetermined time period is equal to L/S where L is the distance between said first and second ends of said tube location of the visible indicator in cm, and $S^{=}(2/9)R^2 A\Delta D/V$, where S=the speed of the spherical visible indicator in cm/s, R=the radius of the spherical visible indicator in cm, ΔD=the density difference between said spherical visible indicator and said fluid in gm./cm$^3$, A=the acceleration of gravity (981 cm./s$^2$), and V=the absolute viscosity of said fluid in gm./cm second.

23. A time indicator as recited in claim 21 wherein said visible indicator and said viscous liquid are selected so that said elapsed time indicator indicates the passage of about one day or more when said visible indicator passes from said first end to said second end, or vice-versa, if maintained at a temperature between about 5°–30°.

24. An elapsed time indicator as recited in claim 21 further comprising two separate tubes colinearly joined and having first and second interior cavities between said first and second ends thereof: and wherein said visible indicator comprises a first visible indicator disposed in said first interior cavity, and further comprising a second visible indicator disposed in said second interior cavity.

* * * * *